US005730285A

United States Patent [19]

Sheehan

[11] Patent Number: 5,730,285

[45] Date of Patent: Mar. 24, 1998

[54] ALTERNATIVE GOLF BAG

[76] Inventor: Bruce W. Sheehan, 13 Valleywood Dr., Glenville, N.Y. 12302

[21] Appl. No.: 645,422

[22] Filed: May 13, 1996

[51] Int. Cl.[6] ..... A63B 55/00

[52] U.S. Cl. ..... 206/315.3; 206/315.2; 206/315.5; 206/315.6; 206/315.7

[58] Field of Search ..... 206/315.2–315.8

[56] References Cited

U.S. PATENT DOCUMENTS

| | | | |
|---|---|---|---|
| 699,391 | 5/1902 | Johnson | 206/315.2 X |
| 1,616,446 | 2/1927 | Fredette | 206/315.5 |
| 1,621,329 | 3/1927 | Malone | 206/315.7 X |
| 1,644,592 | 10/1927 | Howland | 206/315.4 |
| 2,520,226 | 8/1950 | Smith | 206/315.4 X |
| 4,111,248 | 9/1978 | Leichhardt | 206/315.6 |
| 4,643,302 | 2/1987 | Baumgardner | 206/315.3 X |
| 4,673,082 | 6/1987 | Hemme | 206/315.3 X |
| 4,753,446 | 6/1988 | Mills | 206/315.6 X |
| 4,968,048 | 11/1990 | Lortie | 206/315.1 X |
| 5,417,334 | 5/1995 | Wu | 206/315.2 X |

FOREIGN PATENT DOCUMENTS

| | | | |
|---|---|---|---|
| 2603944 | 5/1977 | Germany | 206/315.3 |

*Primary Examiner*—Sue A. Weaver

[57] ABSTRACT

An elongated tubular golf club carrying and organizing device (9) having a surrounding plurality of frontal hosel clamps (10) for supporting the head portion of the golf club (24) and a set of cylinder rings (16) for retaining the grip portion of the golf club. The inside structure of the tube is for storage (11) and (18) and is compartmentalized using a divider (23) and opening caps (12) and (19) in strategic locations so to optimize the existing space. To provide ground grass clearance, legs (13) and (20) of sufficient height are implemented at locations front and rear for proper support.

1 Claim, 1 Drawing Sheet

ALTERNATIVE GOLF BAG

BACKGROUND OF THE INVENTION

This invention relates to golf bags, and golf club securing and organization devices. This concept varies greatly from all current designs in that the plurality of clubs are presented on the outside of the unit individually. This prevents the clubs from clashing against one another eliminating noise and protecting the shafts and club heads. Each club is directly displayed and easily visible at a glance. This invention allows the golf clubs to be extracted and reattached from the side of the unit instead of having to manage them through the top of the golf bag.

In prior art the golf club shafts have had some point of contact. No attempt has been made to protect shafts from contacting either the golf bag dividers, inserts, individual pockets, or one another. Dividers, pouches, pockets, spring clips, devices that hold the heads in place, and individual separation tube inserts, all fail in one respect or another to eliminate the problem of defacing the shaft surface. This proposes a special concern for graphite shafts due to their susceptibility to marring. Also, this plurality arrangement will prevent the incidental scratching of chrome plated metal shafts.

U.S. Pat. No. 2,436,687 proposes a rack system for supporting the club heads. Although the upper separation extensions adequately support the heads, the shaft and grip portion of the clubs are not sufficiently immobilized and can disengage during use and escape while in transport.

The golf club heads are shown secured and separated in the U.S. Pat. No. 3,503,518 golf bag insertion device. This prior art fails in that the club shafts protrude into the golf bag cavity contacting other shafts within the bag. This eventually leads to the defacing of the club shafts.

U.S. Pat. Nos. 2,722,258, 3,053,298, 3,101,108, 5,383,555 and 5,450,958 depict insertion devices of various lengths harnessed within the golf bag for the purpose of separating clubs. The prior art subjects the club shafts to marring when scraped along the throat of the individual club separation devices during club extraction and insertion.

U.S. Pat. Nos. 2,685,317, 4,194,547, and 5,465,839 are golf bags that implement a plurality of compartments, club separation devices and dividing tubes exposing the golf club shafts to wear rings at the point where the club exits the individual divider device. The wear ring is caused when the club sways back and forth during play if walking, pulled by hand cart, or carried in a motorized cart. The entire length of the shafts are also subject to scraping during extraction and insertion.

SUMMARY OF THE INVENTION

This innovative golf bag has several features, all of which contribute to its desirable attributes. The claims that follow will not limit the scope of this invention. The prominent features will now be briefly discussed. To accomplish the objects and features, the present invention provides a tubular storage receptacle main body supporting a plurality of clamps near the front of the bag which secures each individual club head in place by immobilizing the hosel. The rear section of the bag arranges a plurality of cylinders which provide a dividing mechanism for the unrestricted storage of each individual club grip. This arrangement provides for sets of clubs of different lengths. The front cap of the bag unscrews to reveal a closed bottom interior cavity used for the storage of golf balls, tees and miscellaneous items. A cap at the rear of the bag unscrews to reveal an interior storage compartment for a golf umbrella, golf balls and other miscellaneous items. These interior cavity compartments are divided by implementing a division plate to keep stored items from falling into one another's compartment. The front and back leg support units provide elevation to the bag giving clearance between the ground grass and clubs while in the prone position. The bag may also be leaned in an upright position against a stationary object implementing the aforementioned legs.

The dislodging of any component is prevented due to the golf club securing devices and interior compartment screw caps. This even applies when the invention is held upside down.

Additional features may be adapted to the preferred embodiment as follows:

1. The invention may come in a variety of different colors.
2. Attachments can be adapted for securing the unit to driving and pull golf carts.
3. The invention can be easily converted into to a pull golf cart version by the addition of wheels and a pull handle.
4. Each outside grip cylinder wall or hosel clamp could be embossed with the corresponding club number.
5. Retainment cups can be inserted into the grip cylinder stabilizers so the club grip will bottom out before being secured by the hosel clamp.
6. The entire invention can be inserted into a padded protective carrying case during non-play transportation.
7. The Golf Bag with External Individual Golf Club Attachment Structures can be produced by assembling lightweight components, by injection mold, etc.

REFERENCE NUMERALS IN DRAWING

Figure 1:
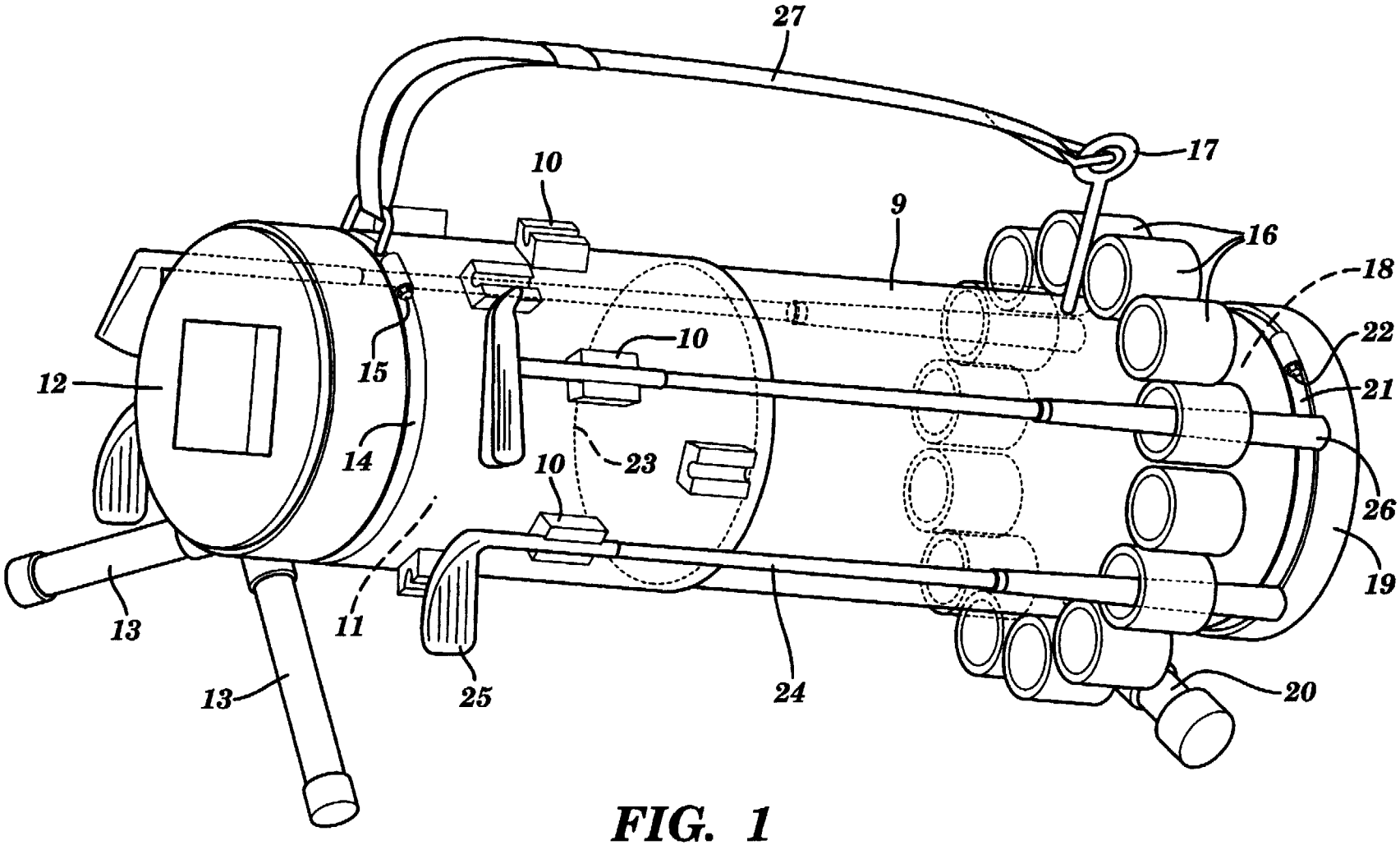
FIG. 1 is a side view of the Golf Bag with External Individual Golf Club Attachment Structures with golf clubs secured in position.

9. Tubular storage receptacle main body.
10. Hosel clamp.
11. Front interior compartment.
12. Front interior compartment cap.
13. Front legs.
14. Front legs retention strap.
15. Front legs retention strap nut.
16. Grip cylinder.
17. Eye bolt for shoulder strap.
18. Rear interior compartment.
19. Rear interior compartment cap.
20. Rear leg.
21. Rear leg retention strap.
22. Rear leg retention strap nut.
23. Interior compartment division plate.
24. Golf club.
25. Golf club head and hosel.
26. Golf club grip.
27. Shoulder strap.

DESCRIPTION OF THE PREFERRED EMBODIMENT

A profile of the Golf Bag with External Individual Golf Club Attachment Structures is presented in FIG. 1 which depicts the invention in the prone position being supported by the front legs 13 and rear leg 20. The front legs 13 are mounted to the tubular storage receptacle main body 9 with the front legs retention strap 14. The rear leg 20 is mounted to the tubular storage receptacle main body 9 with the rear leg retention strap 21. Both front 14 and rear 21 legs retention straps are fastened to the outside of their respective interior compartments 11 and 18 by worm screws inside the front 15 and rear 22 legs retention strap nuts. The leg assemblies provide clearance keeping the golf clubs from contacting the ground grass.

The front interior compartment 11 is where golf balls, tees and miscellaneous items can be stored. Contents are contained within the unit by screwing on the front interior compartment cap 12. The rear interior compartment 18 is where a golf umbrella, golf balls and additional miscellaneous items can be stored. Contents are contained within by screwing on the rear interior compartment cap 19. Both interior compartments are separated by an interior compartment division plate 23.

The preferred embodiment will be carried via a shoulder strap 27. The shoulder strap points of attachment will be at the rear eye bolt 17 and the front legs retention strap 14.

All golf clubs 24 will be arranged in parallel positions circumferencing the tubular storage receptacle main body 9. The plurality of hosel clamps 10 are attached to the front interior compartment shell 11. The hosel clamp 10 immobilizes the club head 25 by friction fitting the hosel. The plurality of grip cylinders 16 stabilize the grip end of the golf club 26, but does not limit the depth of penetration. This allows for any length set of clubs to be attached.

I claim:

1. A golf club transporting device as a means of carrying a plurality of golf clubs in a directly displayed exposed cylindrical presentation, said golf club transport device comprising:

a) a cylindrical tubular storage receptacle main body opened at each end to define a first and second storage compartment;

b) an interior storage compartment division plate separating said storage compartments as part of said tubular storage receptacle main body;

c) a plurality of resilient gripping hosel clamps fixed around the first storage compartment and circumferencing the exterior of said tubular storage receptacle main body with each clamp positioned for engaging the hosel of a golf club;

d) a plurality of unrestrictive grip receiving cylinders fixed around the second storage compartment and circumferencing said tubular storage receptacle main body with each cylinder disposed such that it is aligned with a respective clamp to secure any length club;

e) a set of storage compartment retaining caps including means for removing and securing to the open ends of the tubular storage receptacle main body for closing the first and second storage compartments;

f) a plurality of supporting legs attached to said tubular storage receptacle main body for elevating the receptacle main body and;

g) means for carrying attached to said tubular storage receptacle main body;

wherein a set of golf clubs may be secured only to the exterior of the tubular receptacle main body with each club grip coming to rest somewhere within a respective cylinder, regardless of the length of the club.

* * * * *